US010029185B2

(12) United States Patent
Cai

(10) Patent No.: US 10,029,185 B2
(45) **Date of Patent: *Jul. 24, 2018**

(54) COMBINED TOY TOP THAT CAN BE FREELY ASSEMBLED

(71) Applicants: Guangdong Alpha Animation & Culture Co., Ltd., Shantou (CN); Guangdong Auldey Animation & Toy Co., Ltd., Guangzhou (CN); Guangzhou Alpha Culture Communications Co., Ltd., Guangzhou (CN)

(72) Inventor: Dongqing Cai, Shantou (CN)

(73) Assignees: Guangdong Alpha Animation & Culture Co., Ltd. (CN); Guangdong Auldey Animation & Toy Co., Ltd. (CN); Guangzhou Alpha Culture Communications Co., Ltd. (CN)

( * ) Notice: Subject to any disclaimer, the term of this patent is extended or adjusted under 35 U.S.C. 154(b) by 58 days.

This patent is subject to a terminal disclaimer.

(21) Appl. No.: 14/784,453

(22) PCT Filed: Apr. 14, 2015

(86) PCT No.: PCT/CN2015/076506
§ 371 (c)(1),
(2) Date: Oct. 14, 2015

(87) PCT Pub. No.: WO2016/026318
PCT Pub. Date: Feb. 25, 2016

(65) Prior Publication Data

US 2016/0228778 A1 Aug. 11, 2016

(30) Foreign Application Priority Data

Aug. 16, 2014 (CN) ..... 2014 1 0402519

(51) Int. Cl.
*A63H 1/18* (2006.01)
*A63H 1/00* (2006.01)
*A63H 1/06* (2006.01)

(52) U.S. Cl.
CPC ..... *A63H 1/18* (2013.01); *A63H 1/00* (2013.01); *A63H 1/06* (2013.01)

(58) Field of Classification Search
CPC . A63H 1/00; A63H 1/18; A63H 33/00; A63H 33/04
See application file for complete search history.

(56) References Cited

U.S. PATENT DOCUMENTS 1,265,644 A * 5/1918 Frederick ..... A63H 1/28 446/258
3,201,896 A * 8/1965 Dalhart ..... A63H 1/18 446/257

(Continued)

FOREIGN PATENT DOCUMENTS

CN 2392579 Y 8/2000
CN 102371071 A 3/2012

(Continued)

OTHER PUBLICATIONS

International Search Report for Application No. PCT/CN2015/076506 dated Jul. 17, 2015.

(Continued)

*Primary Examiner* — Gene Kim
*Assistant Examiner* — Alyssa Hylinski
(74) *Attorney, Agent, or Firm* — Lerner, David, Littenberg, Krumholz & Mentlik, LLP

(57) ABSTRACT

A combined toy top comprises an upper top and a bottom top that are assembled together. The upper top and the bottom top both comprise a central axis body and a top ring fitting over the central axis body. The direction in which the top (Continued)

ring is installed on the central axis body can be turned over between a top face and a bottom face and, therefore, a combined toy top with a variety of assembly ways may be achieved by turning the direction of the top ring on the central axis body. As a result, more powerful attacks and a higher victory rate during games can be realized. Furthermore, a user may form tops of various shapes and centers of gravity by turning the direction of the top ring on the central axis body for adaption to different games and attacks.

20 Claims, 10 Drawing Sheets

(56) References Cited

U.S. PATENT DOCUMENTS

| | | | | |
|---|---|---|---|---|
| 5,020,798 | A * | 6/1991 | Yang | A63H 1/04 273/440 |
| 5,941,753 | A * | 8/1999 | Diresta | A63H 1/18 446/257 |
| 6,364,734 | B1 * | 4/2002 | Ng | A63H 1/00 446/236 |
| 6,666,743 | B2 * | 12/2003 | Polare | A63H 1/04 446/242 |
| 9,737,820 | B2 * | 8/2017 | Cai | A63H 1/00 |
| 2008/0214088 | A1 * | 9/2008 | Chu | A63H 1/06 446/248 |
| 2009/0253344 | A1 * | 10/2009 | Ujita | A63H 1/02 446/256 |

FOREIGN PATENT DOCUMENTS

| | | | |
|---|---|---|---|
| CN | 202237237 | U | 5/2012 |
| CN | 202315281 | U | 7/2012 |
| CN | 202983179 | U | 6/2013 |
| CN | 103585763 | A | 2/2014 |
| CN | 104174168 | A | 12/2014 |
| EP | 3012004 | A1 | 4/2016 |
| JP | S50002500 | | 5/1973 |
| JP | S50002500 | U1 | 1/1975 |
| JP | S55142196 | U | 10/1980 |
| JP | 2010284490 | A | 12/2010 |
| JP | 2011206509 | A | 10/2011 |
| KR | 20100137171 | A | 12/2010 |
| WO | 2013078896 | A1 | 6/2013 |

OTHER PUBLICATIONS

Extended European Search Report for Application No. EP15766040 dated Jan. 9, 2017.

* cited by examiner

COMBINED TOY TOP THAT CAN BE FREELY ASSEMBLED

CROSS-REFERENCE TO RELATED APPLICATIONS

The present application is a national phase entry under 35 U.S.C § 371 of International Application No. PCT/CN2015/076506 filed on Apr. 14, 2015, which claims priority from Chinese Application No. 201410402519.2 filed on Aug. 16, 2014, all of which are incorporated herein by reference.

FIELD OF THE INVENTION

The present invention relates to the toy field, and in particular to a combined toy top that can be freely assembled.

DESCRIPTION OF THE RELATED ART

Existing toy tops are basically formed by one single top, which comprises a central axis jacket, a top cap, a top ring and a top tip. The top is ejected to rotate through the connection of a top launcher and the top cap. In the play process, the toy top engages in the rotating confrontation only with one single-layer top. As a result, the attack is not powerful enough during combat games, and its victory rate is difficult to be improved. Although combined toy tops were later invented, the drawback thereof is that there is only one way of assembly, i.e. the top ring and the central axis body can only be installed in a unified direction without the ability to turn directions. Consequently, it can only achieve one type of attack. Therefore, there is only one way of playing games, and a user may not select a different way of attack according to the characteristics of an opponent's top. With existing combined toy tops, in addition, the top ring is locked to the central axis body mainly through the top cap during the assembly, leading to a very difficult assembly, and as a result, it is difficult to meet the need of consumers.

SUMMARY OF THE INVENTION

The object of the present invention is, aiming at the above problems and drawbacks, to provide a combined toy top that not only can form a top combination through the assembly of an upper top and a bottom top with more powerful attack and high victory rate, but also can realize attacks in various ways as a user can choose different assembly methods according to different situations. In addition, it has a simple structure, easy installation and diverse methods of assembly.

On the basis of the above, a further object of the present invention is to provide a combined toy top that can be freely assembled with convenient docking of an upper top and a bottom top, a reliable docking structure, easy and rapid operations and beautiful appearance.

The technical solution employed by the present invention is as follows:

The combined toy top that can be freely assembled according to the present invention comprises an upper top and a bottom top that are assembled together, characterized in that the upper top and the bottom top both comprise a central axis body and a top ring fitting over the central axis body, the direction in which the top ring of at least one top of the upper top and the bottom top is installed on the central axis body can be turned over between a top face and a bottom face (also referred to as front and back faces), and therefore, a combined toy top with a variety of assembly ways may be achieved by turning the direction of the top ring on the central axis body.

To further enhance the diversity of its games, the directions in which the top rings of the upper top and the bottom top are installed on the central axis bodies can be both turned over between a top face and a bottom face, and therefore, a combined toy top with four assembly ways may be achieved by turning the direction of each top ring on the respective central axis body. Namely, the first combined toy top is that both the upper and bottom top rings are installed on the central axis body with the front faces upwardly; for the second and third combined toy tops, one of the upper and bottom top rings is installed on the central axis bodies with the front face upwardly, and the other one is installed on the central axis bodies with the back face upwardly; for the fourth combined toy top, both the upper and bottom top rings are installed on the central axis body with the back faces upwardly.

Of course, the specific docking way of the upper top and the bottom top may be determined as needed, for example, they may be reliably snapped together by means of the rotation snap structure provided on the top rings of the upper top and the bottom top. To make the present invention to have convenient assembly and a reliable connection structure, also to make the assembled combined toy top to have a beautiful appearance, the upper top and the bottom top may also be reliably connected together by means of an insertion connection structure or a rotation snap structure provided on the central axis body. To make the connection structure of the two central axis bodies simpler, the rotation snap structure comprises a snap member that is rotatably disposed at the bottom of the central axis body of the upper top, a cavity is correspondingly formed on the upper part of the central axis body of the bottom top for the lower part of the central axis body of the upper top to be inserted in, and a snap position is provided within the cavity for engagement with the snap member, and the reliable snap connection of the two central axis bodies can be realized by inserting the snap member at the bottom of the central axis body of the upper top into the cavity and then rotating the snap member of the upper top.

To make the connection structure of the two docked central axis bodies of the two tops more reliable, such that the phenomenon of easy disengagement due to collision and other reasons during games can be avoided, and moreover, the snap member at the bottom of the central axis body can be rotated as directly driven by the top cap without driving the snap member to rotate while the top cap is taken apart, a clutch transmission mechanism is provided in the central axis body of the upper top for driving the snap member to rotate and capable of engagement with the bottom of the top cap on the central axis body, the upper part of the clutch transmission mechanism may be clipped to the upper part of the central axis body, and moves downwardly when being pressed down by the top cap, thereby releasing the clipping with the central axis body and meshing with the snap member. At this moment, the top cap rotates the clutch transmission mechanism to drive the snap member to rotate, and when the downward pressing force by the top cap disappears, the clutch transmission mechanism automatically moves upwardly and is reset. At this time when the top cap is rotated and taken out, the snap member will not be driven to rotate.

To make the connection of the top ring and the central axis body is still reliable and will not get loose after the top cap is removed, so as to facilitate the turning installation of the top rings during games, a snap protrusion locking structure is provided on the top ring for connecting with the central axis body, and the top ring is reliably connected to the central axis body through the snap protrusion locking structure; alternatively, a retaining structure is provided on the central axis body for reliable rotating connection with the corresponding top ring.

To make the rotation inertia of the top rings higher, the engagement with the central axis bodies tight and the assembly more convenient, each of the top rings comprises an external attack ring and a screw ring for achieving a reliable connection between the external attack ring and the central axis body, and a snap protrusion locking structure is provided on the screw ring for engagement with the central axis body. The attack ring is made of a metal, and the screw ring is made of plastics or rubber. To form tops of various shapes and centers of gravity that are significantly different after the direction of the top ring is turned over in the present invention, and to make the appearance more beautiful and the structure more reliable, the upper and bottom top rings comprise upper cap rings and lower cap rings for engagement with the attack ring through holes, and the upper cap rings and the lower cap rings have different shapes or configurations of center of gravity, the snap protrusion locking structure comprises an upper snap protrusion and a lower snap protrusion that are provided corresponding on the inner walls of the upper cap ring and the lower cap ring, when the central axis body is fitted into the ring hole of the corresponding upper cap ring and lower cap ring, the upper cap ring and the lower cap ring are engaged with the retaining structure provided on the corresponding central axis body by means of the upper and lower snap protrusion, thereby achieving a reliable connection with the central axis body.

To make the connection structure between the central axis body and the top ring more reliable, the above two central axis bodies comprise axis jackets and snap rings rotatably disposed on the axis jackets, the retaining structure comprises a snap groove formed axially on the external wall of the axis jacket for the snap protrusion locking structure to slide in, and a snap pin integrally formed on the snap ring and extending out of the axis jacket, a guide groove is correspondingly formed on the external wall of each of the axis jackets for the snap pin to extend out and rotate horizontally, when the snap protrusion locking structure of the screw ring slides into the snap groove, the snap ring may be rotated such that the snap pin rotates to under or above the snap protrusion locking structure, making the snap protrusion locking structure reliably locked between the snap pin and one end edge of the snap groove so as to realize the reliable connection between the top ring and the central axis body.

As the present invention employs a structure that assembles the upper top and the bottom top into a top assembly and has the top ring of at least one top installed on the central axis body in a manner that it can be turned over vertically, the present invention can achieve more powerful attacks and a higher victory rate during games through the assembly of two tops. Moreover, the top ring of the top can be installed on the central axis body in a manner that it can be turned over vertically, namely either the top face (front face) is installed on the central axis body upwardly, or the bottom face (back face) is installed on the central axis body upwardly. Therefore, a user may form tops of various shapes and centers of gravity by turning the direction of the top ring on the central axis body according to different situations, such that the assembly thereof is diversified to realize different ways of games and attacks. Moreover, the present invention has a simple structure and easy installation, which effectively solves the problems of the existing tops that there is only one way of assembly and games and the attack is not powerful. As the present invention further employs a structure that reliably snaps the upper top and the bottom top together by means of a rotation snap structure provided on the central axis body, the two tops are conveniently assembled and the connection structure is reliable, and at the same time, the combined top after assembly has a beautiful appearance. As the present invention further employs a rotation snap structure provided on the central axis body of the upper top, composed of a snap member and a clutch transmission mechanism for driving the snap member to rotate and capable of engagement with the top cap for transmission, moreover, it ensures the reliable connection of the two central axis bodies, such that the phenomenon of easy disengagement due to collision and other reasons during games can be avoided. In addition, the operation is simple and the use is extremely convenient. The present invention not only has simple assembly and diverse ways of assembly, but also has more powerful attacks and a higher victory rate. Furthermore, a user can realize attacks in various ways by choosing different assembly methods according to different situations, which can meet the need of consumers.

The present invention will be further described below with reference to the accompanying drawings.

DETAILED DESCRIPTION OF THE EMBODIMENTS

Figure 1:
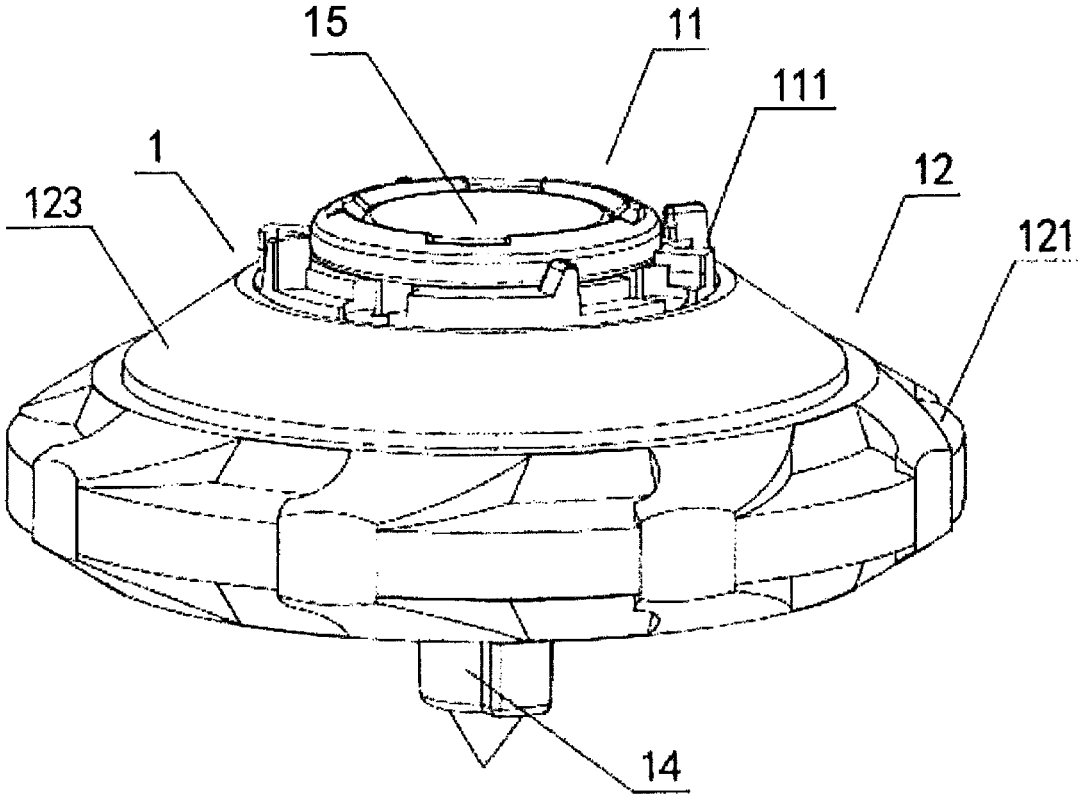
FIG. 1 illustrates the structure of one embodiment of the upper top according to the present invention.
Figure 2:
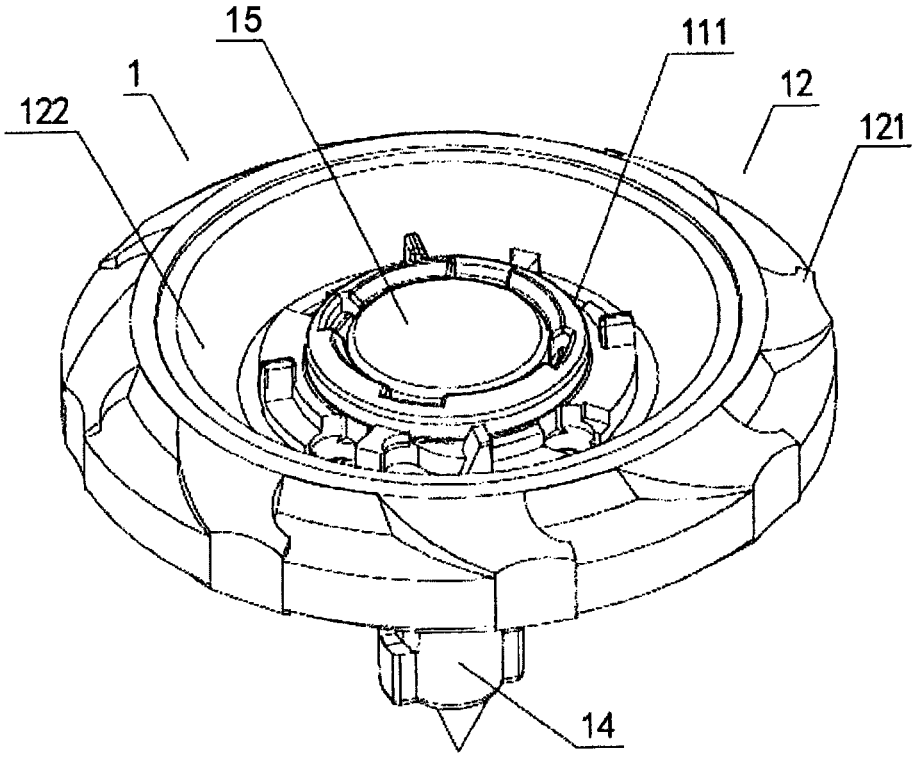
FIG. 2 illustrates the structure of the top ring in FIG. 1 installed on the central axis body after the direction has been turned over vertically.
Figure 3:
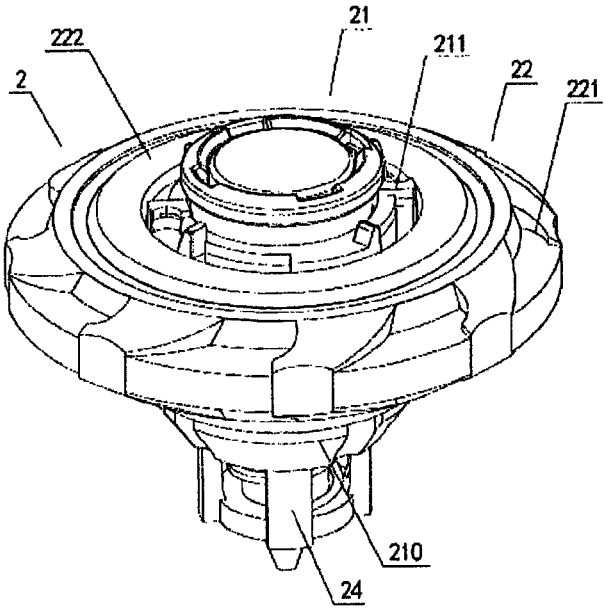
FIG. 3 illustrates the structure of one embodiment of the bottom top according to the present invention.
Figure 4:
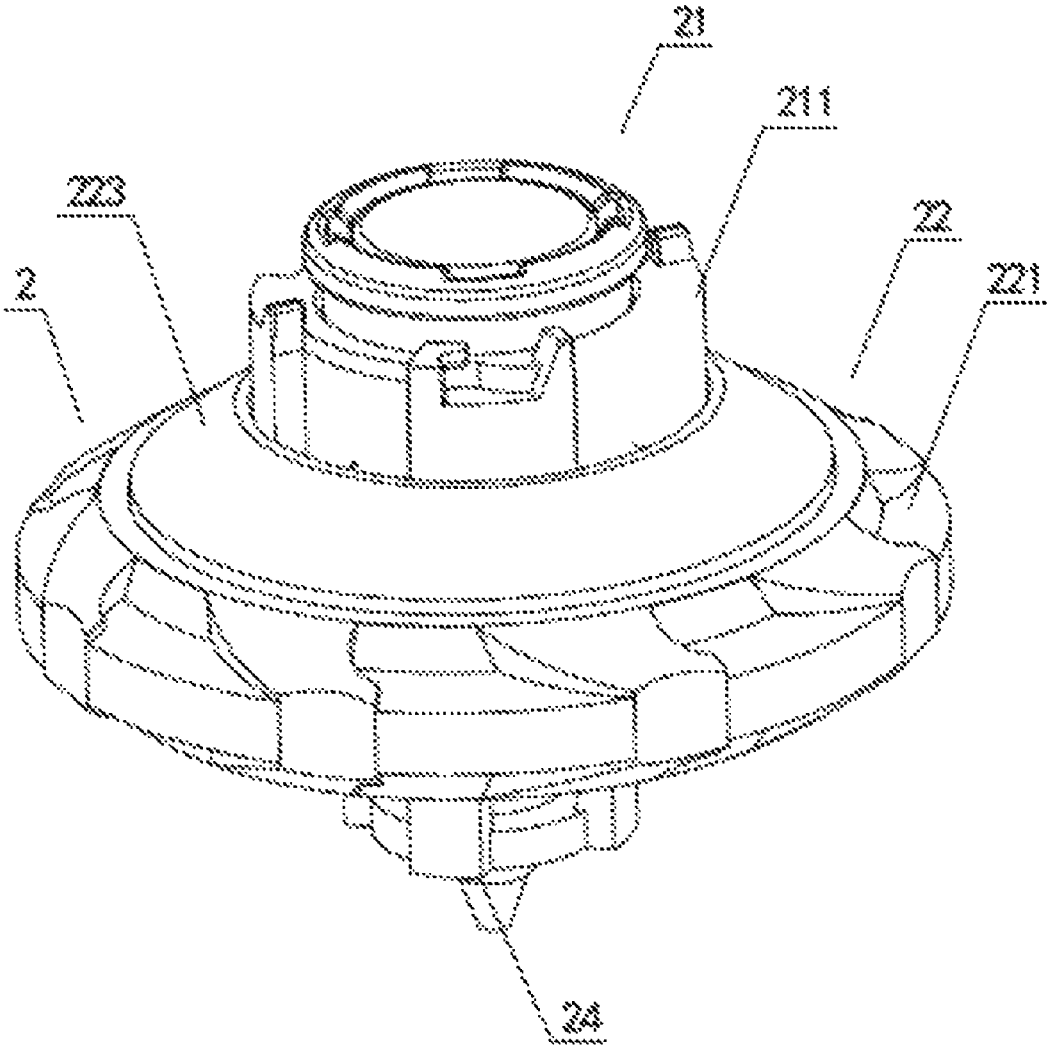
FIG. 4 illustrates the structure of the top ring in FIG. 3 installed on the central axis body after the direction has been turned over vertically.
Figure 5:
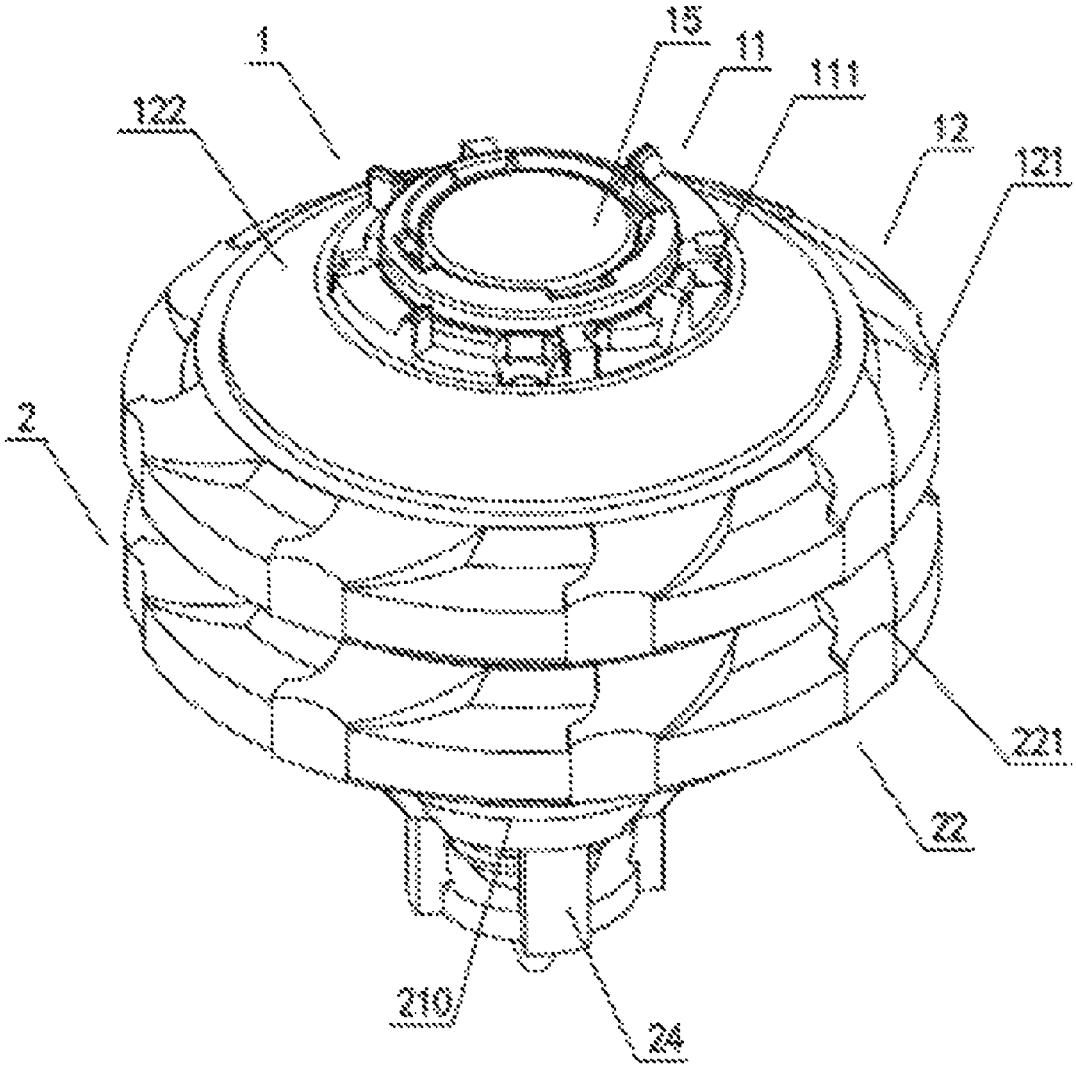
FIG. 5 illustrates the structure of the assembly of the bottom top in FIG. 3, with the top cap removed, with the upper top in FIG. 1.
Figure 6:
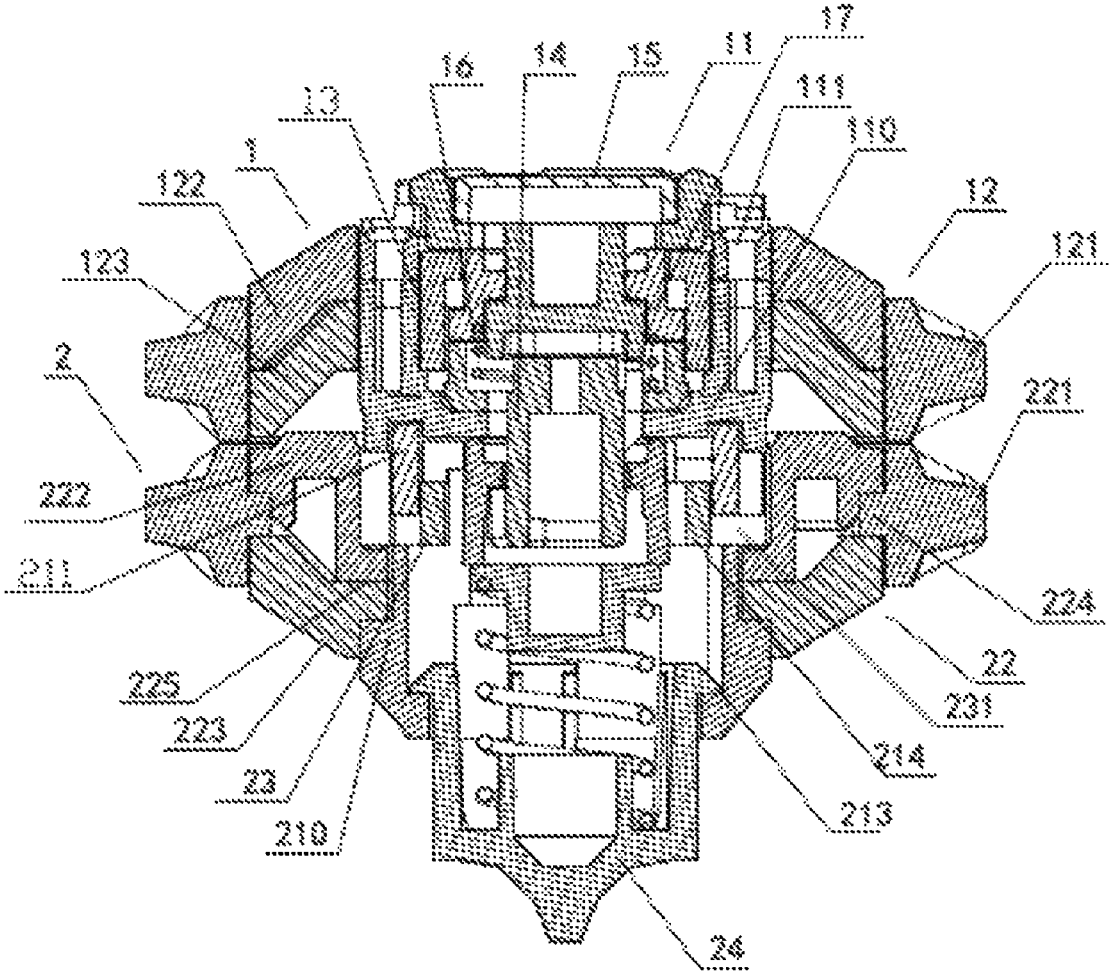
FIG. 6 is a cross sectional view of FIG. 5.
Figure 7:
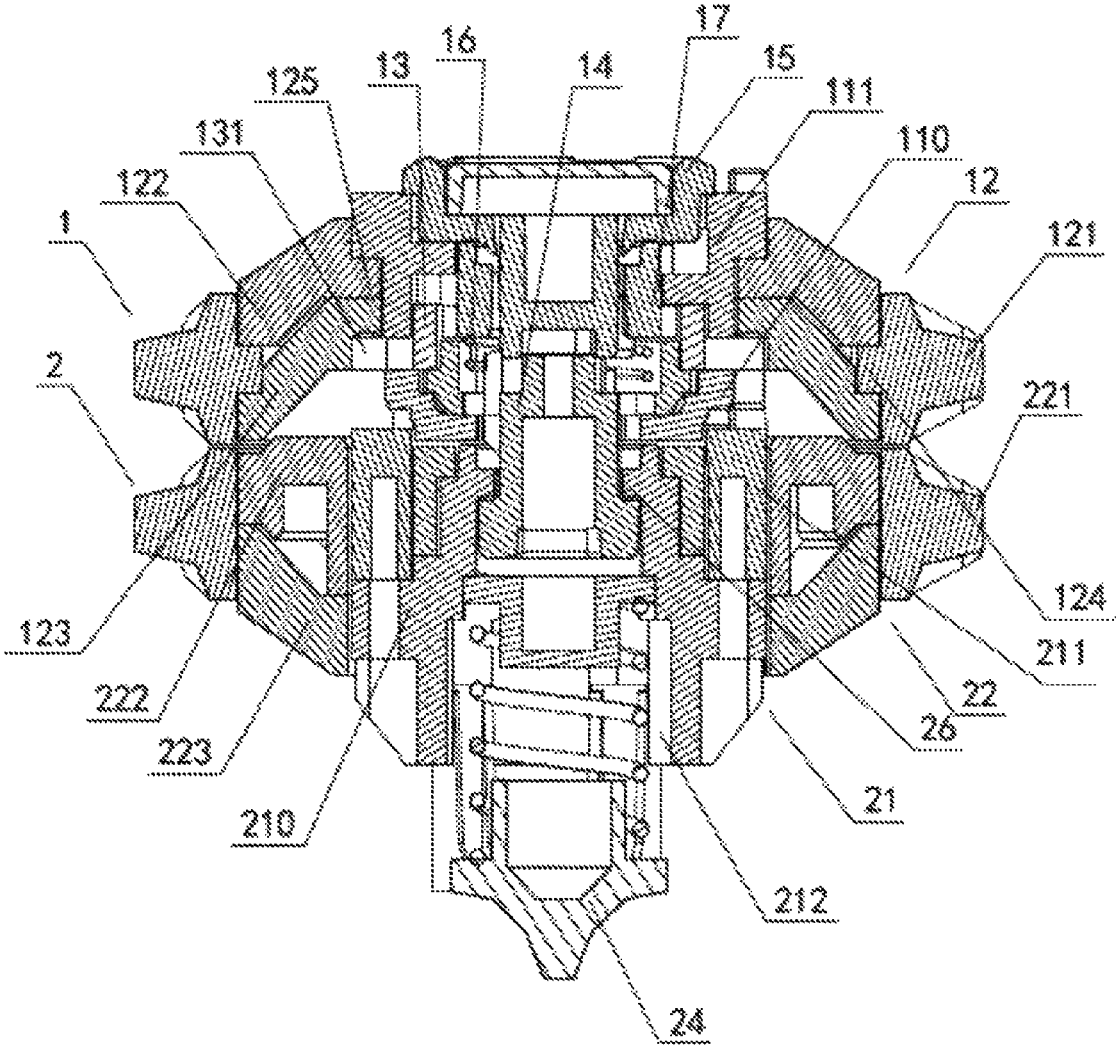
FIG. 7 is another cross sectional view of FIG. 5.
Figure 8:
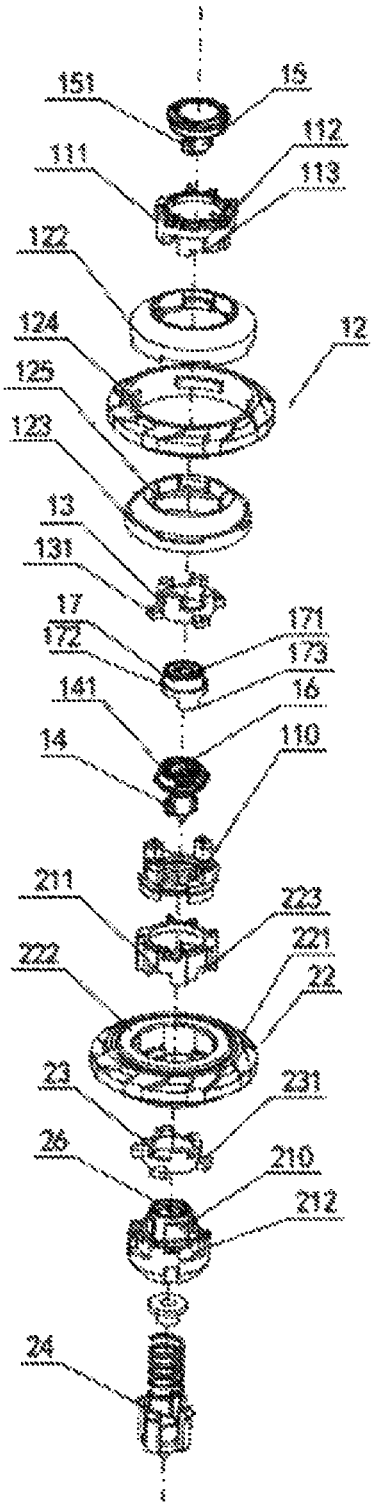
FIG. 8 illustrates the assembly structure of FIG. 5.
Figure 9:
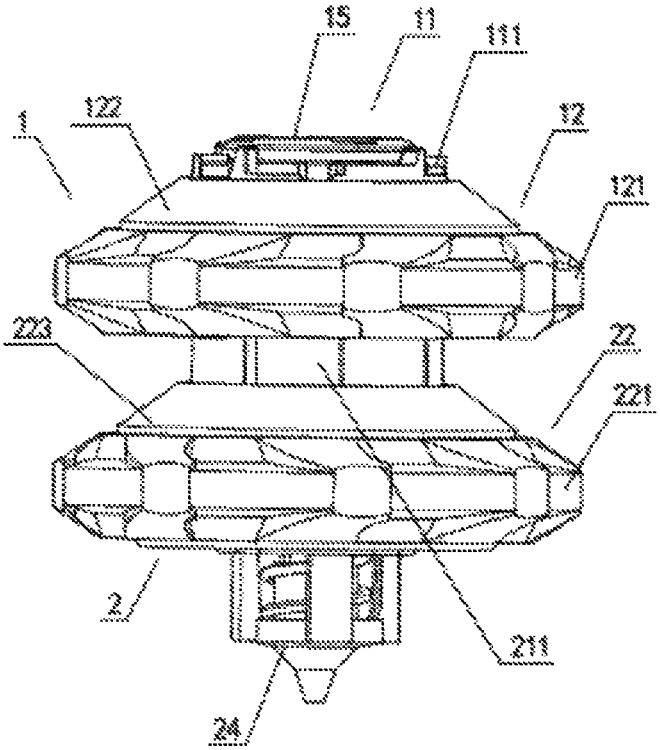
FIG. 9 illustrates the structure of the assembly of the bottom top in FIG. 4, with the top cap removed, with the upper top in FIG. 1.
Figure 10:
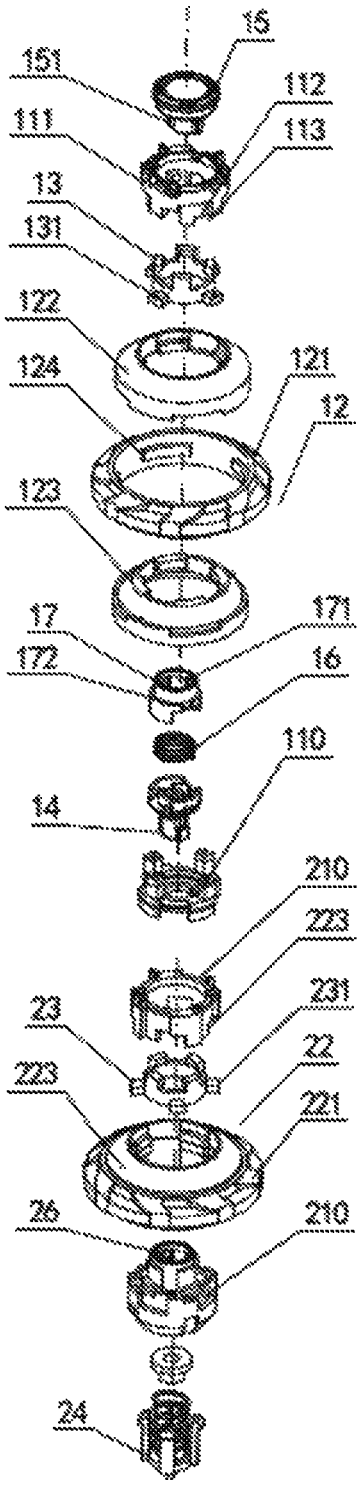
FIG. 10 illustrates the assembly structure of FIG. 9.
Figure 11:
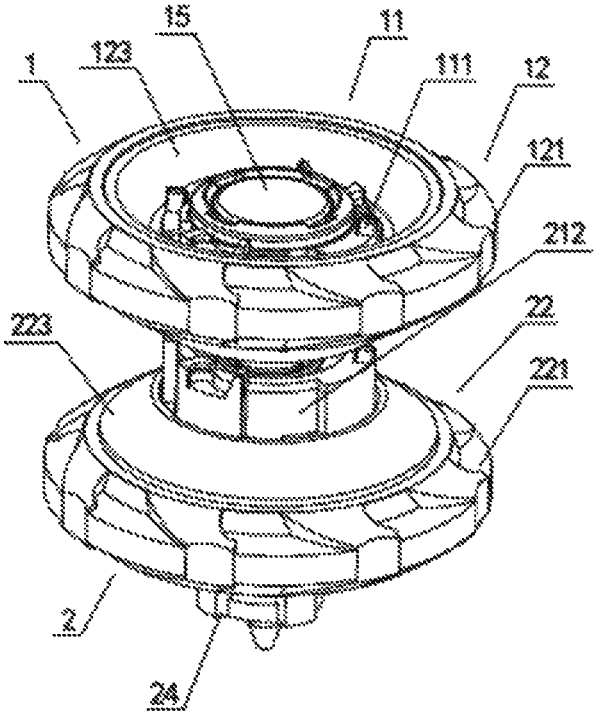
FIG. 11 illustrates the structure of the assembly of the bottom top in FIG. 3, with the top cap removed, with the upper top in FIG. 2.
Figure 12:
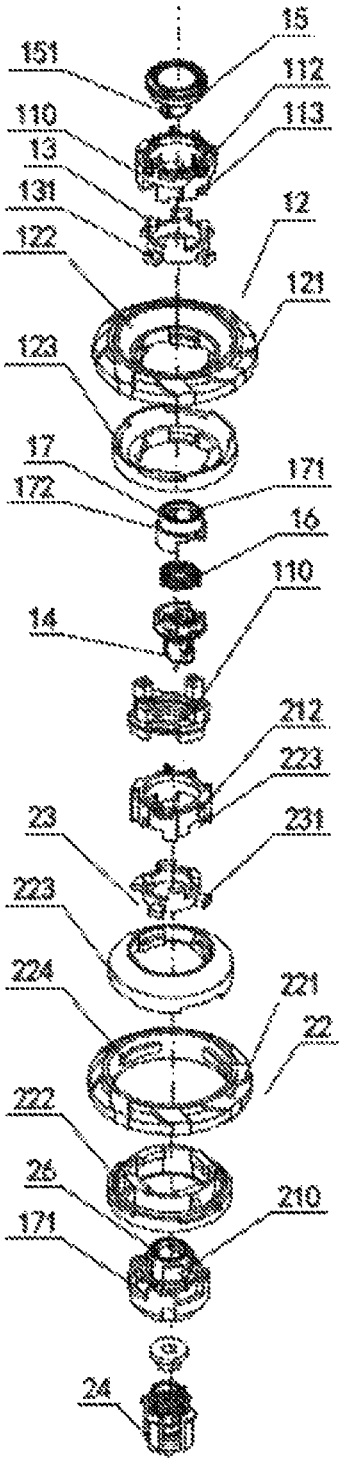
FIG. 12 illustrates the assembly structure of FIG. 11.
Figure 13:
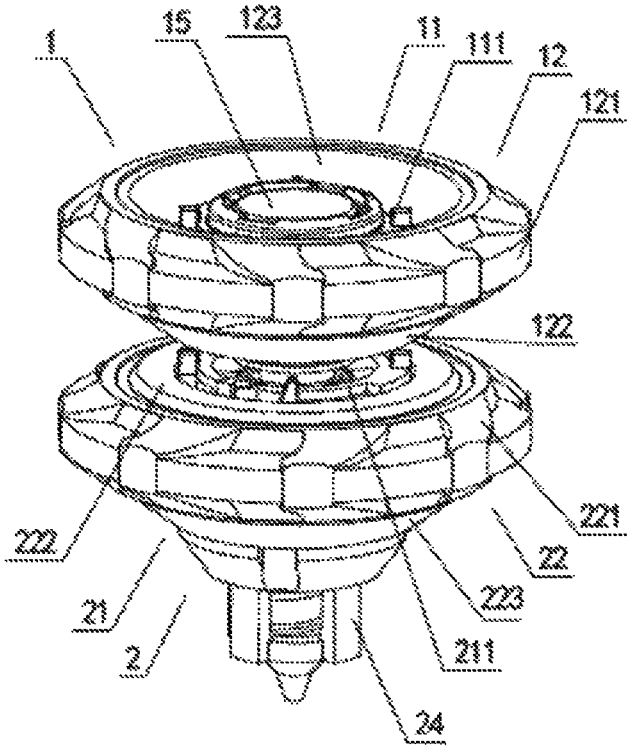
FIG. 13 illustrates the structure of the assembly of the bottom top in FIG. 4, with the top cap removed, with the upper top in FIG. 2.
Figure 14:
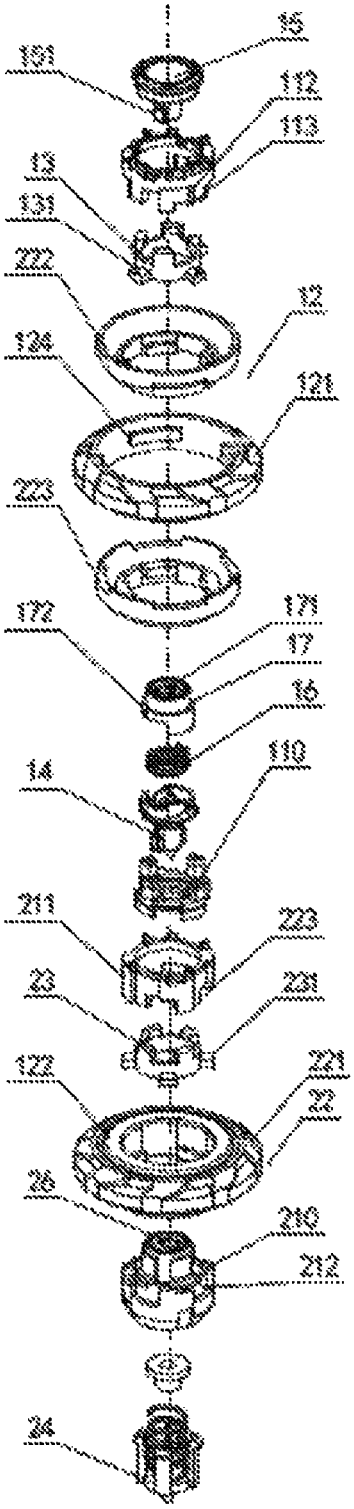
FIG. 14 illustrates the assembly structure of FIG. 13.

As shown in FIG. 1 to FIG. 14, the combined toy top that can be freely assembled according to the present invention comprises an upper top 1 and a bottom top 2 that are assembled together, to make the play mode and functions of the present invention more diverse, the upper top 1 and the bottom top 2 both comprise central axis bodies 11, 21, and top rings 12, 22 fitting over the central axis bodies 11, 21, the direction in which the top ring of at least one top of the upper top 1 and the bottom top 2 is installed on the central axis body can be turned over between a top face and a bottom face (also referred to as front and back faces) (namely either the top face of the top ring is installed on the central axis body upwardly, or the bottom face of the top ring is installed on the central axis body upwardly), and therefore, a combined toy top with a variety of assembly ways may be achieved by turning the directions of the top rings 12, 22 on the central axis bodies 11, 21. Since an assembly of two tops 1, 2 is employed during the use of the present invention, the attack is more powerful and the victory rate is higher during games. As the top rings 12, 22 of the tops 1, 2 are installed on the central axis bodies 11, 21 in a manner that they can be turned over vertically, a user may form tops of various shapes and centers of gravity by turning the directions of the top rings 12, 22 on the central axis bodies 11, 21 according to different situations, such that the assembly thereof is diversified to realize different ways of games and attacks, for example, if the center of gravity is low, the endurance is strong; if the center of gravity is high, top attacks may be launched. As a result, the user can select a different way according to the characteristics of an opponent's top, and the game mode is more diversified. This is because changes to the tops' centers of gravity have the following primary impacts: 1. Impact through the height of the designed position of the connection structure between the top rings 12, 22 and the central axis bodies 11, 21, when the directions of the top rings 12, 22 are turned, the height of the position of the connection structure it has with the central axis bodies will change; 2. The difference between the structures of the top and bottom faces of the top rings 12, 22 will also lead to different centers of gravity of the two faces. As a result, the tops after the directions of the top rings are turned have different overall shapes and overall centers of gravity from the original tops. Moreover, the present invention has a simple structure and easy installation, which effectively solves the problems of the existing tops that there is only one way of assembly and games and the attack is not powerful. To further enhance the diversity of its games, the installation directions of the top rings 12, 22 relative to the central axis bodies 11, 21 in the upper and bottom tops 1, 2 can all be turned vertically, a combined toy top with four assembly ways may be achieved by turning the direction of each top ring 12, 22 on the respective central axis body 11, 21. Namely, the first combined toy top is that both the upper and bottom top rings 12, 22 are installed on the central axis bodies 12, 22 with the front faces upwardly, as shown in FIG. 5; for the second and third combined toy tops, one of the upper and bottom top rings 12, 22 is installed on the central axis bodies 11, 21 with the front face upwardly, and the other one is installed on the central axis bodies with the back face upwardly, as shown in FIG. 9 and FIG. 13; for the fourth combined toy top, both the upper and bottom top rings 12, 22 are installed on the central axis bodies 11, 21 with the back faces upwardly, as shown in FIG. 11. To make the connection of the top rings 12, 22 and the central axis bodies 11, 21 is still reliable and will not get loose after the top cap is removed from the top rings 12, 22, so as to facilitate the turning installation of the top rings during games, a snap protrusion locking structure 125, 225 is provided on the top ring 12, 22 for connecting with the central axis body 11, 21, and the top ring 12, 22 is reliably connected to the central axis body 11, 21 through the snap protrusion locking structure 125, 225; alternatively, a retaining structure is provided on the central axis body 11, 21 for reliable rotating connection with the corresponding top ring 12, 22. At the same time, the snap protrusion locking structure may be provided at a position in middle of the height of the top ring 12, 22; or may also be provided at a position not in middle of the height. Particularly when the structural shapes or configurations of center of gravity for the top face and bottom face of the top ring 12, 22 are the same, a snap protrusion locking structure at a position in middle of the height may be used to form a connection structure with the central axis body, such that, when the direction is turned, tops with different centers of gravity are formed. Similarly, the retaining structure on the central axis body may also be provided at a position in middle of the height or a position not in middle of the height. To make the rotation inertia of the present invention higher while having convenient installation, the engagement with the central axis bodies 11, 21 tight and the assembly more convenient, each of the top rings 12, 22 comprises a ring-shaped attack ring 121, 221 with the center being a through hole, and a screw ring engaged with the through hole of the attack ring 121, 221 for achieving a reliable connection between the attack ring 121, 221 and the central axis body 11, 21, the snap protrusion locking structure 125, 225 is provided on the screw ring, and the top ring 12, 22 is reliably connected to the central axis body 11, 21 by means of the snap protrusion locking structure 125, 225 on the screw ring. The attack ring 121, 221 is made of a metal. The screw ring is made of a non-metallic material, such as plastics or rubber. Since the center of the attack ring 121, 221 is a round hole without integrally forming a connection hole or auxiliary radial ribs for connecting to the connection hole, materials and process for the attack rings have been saved, and moreover, more spaces are reserved for tops to expand. As the primary center of gravity of the attack ring 121, 221 with relatively heavy weight is on the peripheral area, the rotation inertia is high. As the snap protrusion locking structure in the screw ring is directly used to lock it onto the central axis body, moreover, the top rings 12, 22 will not get loose from the central axis bodies 11, 21 even when the top cap 15 is taken off. Therefore, the assembly is more convenient. To form tops of various shapes and centers of gravity that are significantly different after the direction of the top ring 12, 22 is turned over in the present invention, and to make the appearance thereof more beautiful and the structure more reliable, the upper and bottom top rings comprise upper cap rings 122, 222, and lower cap rings 123, 223 for engagement with the attack rings 121, 221 through holes, and the upper cap rings 122, 222 and the lower cap rings 123, 223 have different shapes or configurations of center of gravity, the snap protrusion locking structure 125, 225 comprises an upper snap protrusion and a lower snap protrusion that are provided corresponding on the inner walls of the upper cap ring 122, 222 and the lower cap ring 123, 223, when the central axis body 11, 21 is fitted into the ring hole of the corresponding upper cap ring 122, 222 and lower cap ring 123, 223, the upper cap ring 122, 222 and the lower cap ring 123, 223 are engaged with the retaining structure provided on the corresponding central axis body 11, 21 by means of the upper and lower snap protrusion, thereby achieving a reliable connection with the central axis body 11, 21. To make the connection of the attack rings 121, 221 and the top rings reliable, a snap edge 124, 224 is integrally formed on the inner wall of the through hole of the attack ring 121, 221, a notch is correspondingly formed at a position of the upper cap ring 122, 222 and the lower cap ring 123, 223 that corresponds to the snap edge 124, 224, and the upper cap ring 122, 222 and the lower cap ring 123, 223 are reliably positioned on the attack ring 121, 221 by means of the engagement between the notch thereof and the snap edge 124, 224. To make the connection structure between the central axis body 11, 21 and the top ring 12, 22 more reliable, the above two central axis bodies 11, 21 comprise axis jackets and snap rings 13, 23 rotatably disposed on the axis jackets, the retaining structure comprises a snap groove 112, 212 formed axially on the external wall of the axis jacket for the upper and lower snap protrusions to slide in, and a snap pin 131, 231 integrally formed on the snap ring 13, 23 and extending out of the axis jacket, a guide groove 113, 223 is correspondingly formed on the external wall of each of the axis jackets for the snap pin 131, 231 to extend out and rotate horizontally, when the upper and lower snap protrusions of the screw ring slide into the snap grooves 112, 212, the snap ring may be rotated such that the snap pin 131, 231 rotates to under or above the upper and lower snap protrusions, making the upper and lower snap protrusions reliably locked between the snap pin 131, 231 and one end edge of the snap groove 112, 212 so as to realize the reliable connection between the top ring 12, 22 and the central axis body 11, 21. Of course, the specific docking way of the upper and bottom tops 1, 2 may be determined as needed, for example, they may be reliably snapped together by means of the rotation snap structure provided on the top rings 12, 22 of the upper and bottom tops 1, 2. To make the present invention to have convenient assembly and a reliable connection structure, also to make the assembled combined top to have a beautiful appearance, the upper and bottom tops 1, 2 may also be reliably connected together by means of an insertion connection structure or a rotation snap structure provided on the central axis bodies 11, 21. To make the connection structure thereof simpler, the rotation snap structure comprises a snap member 14 that is rotatably disposed at the bottom of the central axis body 11 of the upper top 1, a cavity is correspondingly formed on the upper part of the central axis body 21 of the bottom top 2 for the snap member 14 to be inserted in, and a snap position 26 is provided within the cavity for rotation engagement with the snap member 14, and the reliable snap connection of the two central axis bodies 11, 21 can be realized by inserting the snap member 14 at the bottom of the central axis body 11 of the upper top into the cavity of the bottom top 2 and then rotating the snap member 14 of the upper top 1. To make the structure of the bottom top 2 simpler, the cavity of the bottom top 2 is also capable of engagement with the bottom of the top cap removably installed thereon, namely the cavity may be directly formed by the top cap installation position formed on the central axis body 21 of the bottom top 2. To make the connection structure of the two docked central axis bodies 11, 21 of the two tops 1, 2 more reliable, such that the phenomenon of easy disengagement due to collision and other reasons during games can be avoided, and moreover, the snap member 14 at the bottom of the central axis body 11 can be rotated as directly driven by the top cap 15 without driving the snap member 14 to rotate while the top cap 15 is taken apart, a clutch transmission mechanism is provided in the central axis body 11 of the upper top for driving the snap member 14 to rotate and capable of engagement with the bottom of the top cap 15 on the central axis body 11, the upper part of the clutch transmission mechanism may be clipped to the upper part of the central axis body 11, and moves downwardly when being pressed down by the top cap 15, thereby releasing the clipping with the central axis body 11 and meshing with the snap member 14. At this moment, the top cap 15 rotates the clutch transmission mechanism to drive the snap member 14 to rotate, and when the downward pressing force by the top cap 15 disappears, the clutch transmission mechanism automatically moves upwardly and is reset. To make the assembly of the present invention more convenient, the axis jacket of the upper top 1 comprises an upper and an lower axis jackets 111, 110 in a fitting engagement, the snap member 14 comprises a connection seat rotatably disposed on the lower part of the lower axis jacket 110 and a fitting pole disposed below the connection seat and having snap protrusions on the two external walls, the snap ring 13 and the clutch transmission mechanism are disposed inside the upper axis jacket 111 above the snap member 14, when the clutch transmission mechanism moves upwardly, it can be snapped to the upper axis jacket 111, and when moving downwardly to release the snap with the upper axis jacket 111, it can mesh with the snap member 14 on the lower axis jacket. To make the structure thereof simple and reliable, the clutch transmission mechanism comprises a ring 16 disposed above the snap member 14 and a clutch ring 17 disposed above the ring 16 in a vertically movable manner, the upper part of the clutch ring 17 may be snapped with the upper axis jacket 111, and when being pressed down to move downwardly, it can release the snap with the upper axis jacket 111 and mesh with the snap member 14, and then the clutch ring 17 may be rotated to drive the snap member 14 to rotate, when the downward pressing force disappears, the clutch ring 17 automatically moves upwardly and is reset under the action of the ring 16. For the removable top cap 15 on the upper part of the upper axis jacket 111, protrusions 151) are formed on two sides of the bottom of the top cap 15, a retaining structure 171 is correspondingly provided inside the clutch ring 17 for engagement and snap lock with the protrusions 151 formed on two sides of the lower part of the top cap 15, and moreover, when the top cap 15 engages with the retaining structure 171 for locking with its bottom inserted into the clutch ring 17, the lower cap edge of the top cap 15 is disposed on the upper end of the clutch ring 17. To make the structure of the clutch transmission mechanism more reliable, an external protrusion and a snap groove 172 capable of engagement and snap are correspondingly formed on the inner wall of the upper axis jacket 111 and the upper external wall of the clutch ring 17, and meshable upper and lower raised tooth structures are provided on the bottom of the clutch ring 17 and the upper end 141 of the snap member, respectively. To enable the central axis body 21 of the bottom top 2 to reliably connect with the central axis body 11 of the upper top while the structure is simple, the axis jacket of the lower top 2 comprises an upper and an lower axis jackets 211, 210 in a fitting engagement, wherein the upper part of the lower axis jacket 210 is inserted into the upper axis jacket 211 to form a cavity for engagement and fitting of the snap member 14 of the central axis body of the upper top 1, the snap position 26 is disposed on the inner wall of the cavity, and the snap pin 231 is rotatably disposed between the upper and lower axis jackets 211, 210. To make the lower top 2 to play as a buffer so as to prevent the impact by collision and the overly heavy top from damaging the top tip, and to improve the stability of the top, the bottom of the lower axis jacket 210 is connected to an elastic top tip 24, an upper and lower limiting shoulders 212, 213 are correspondingly formed on the inner wall of the lower axis jacket for engagement with the elastic top tip 24, and alternatively, an uplift member and a lower limiting shoulder are provided inside the lower axis jacket 210 for engagement with the elastic top tip 24. To enable the upper and bottom tops 1, 2 to form two individual tops after being disassembled, the snap member 14 of the upper top 1 is provided with a top tip on the bottom thereof. The top tip is usually a metal top tip. To make the structure of the central axis bodies of the top to be more reliable, the upper and lower axis jackets 111, 110 of the upper top 1 are locked with the upper and lower axis jackets 211, 210 of the bottom top 2, respectively, via locking screws. The present invention not only has simple assembly and diverse ways of assembly, but also has more powerful attacks and a high victory rate. Furthermore, a user can realize attacks in various ways by choosing different assembly methods according to different situations, which can meet the need of consumers Although the present invention is described with reference to specific embodiments, the description does not mean that it limits the present invention. With reference to the description of the present invention, other variations of the disclosed embodiments can be anticipated by those skilled in the art, and shall be encompassed by the appended claims.

The invention claimed is:

1. A combined toy top that can be freely assembled, comprising an upper top and a bottom top that are assembled together, characterized in that the upper top and the bottom top both include a central axis body, and an upper top ring associated with the upper top and a bottom top ring associated with the bottom top, the upper top ring and bottom top ring fitted over a corresponding central axis body, wherein the upper and bottom top rings each comprise an attack ring and a screw ring received within a center through hole of the corresponding attack ring, each screw ring comprising an upper cap ring and a lower cap ring, each screw ring providing a connection between a corresponding attack ring and central axis body, the direction in which the top ring of at least one of the upper top and the bottom top is installed on a corresponding central axis body can be turned over between a top face and a bottom face, and therefore, a combined toy top with a variety of assembly structures having different configurations of centers of gravity may be achieved by turning the direction of at least one of the upper and bottom top rings on a corresponding central axis body.

2. The combined toy top that can be freely assembled according to claim 1, characterized in that the directions in which the top rings of the upper top and the bottom top are installed on the central axis bodies can be both turned over between a top face and a bottom face, and therefore, a combined toy top with four assembly ways may be achieved by turning the direction of each top ring on one of the respective central axis bodies.

3. The combined toy top that can be freely assembled according to claim 1, characterized in that the upper top and the bottom top are reliably connected together by means of a rotation snap structure provided on the upper and bottom top rings; alternatively, the upper top and the bottom top may be reliably connected together by means of an insertion connection structure or a rotation snap structure provided on the central axis bodies of the upper top and bottom top.

4. The combined toy top that can be freely assembled according to claim 3, characterized in that the rotation snap structure when provided on the central axis bodies comprises a snap member that is rotatably disposed at the bottom of the central axis body of the upper top, and a cavity is correspondingly formed on the upper part of the central axis body of the bottom top for the snap member to be inserted in, and a snap position is provided within the cavity for rotation engagement with the snap member , and the reliable snap connection of the two central axis bodies can be realized by inserting the snap member at the bottom of the central axis body of the upper top into the cavity of the bottom top and then rotating the snap member, and the cavity of the bottom top may also engage with a bottom of a top cap removably installed thereon.

5. The combined toy top that can be freely assembled according to claim 4, characterized in that a clutch transmission mechanism is provided in the central axis body of the upper top for driving the snap member to rotate and is capable of engagement with the bottom of the top cap on the central axis body of the upper top, the upper part of the clutch transmission mechanism may be clipped to an upper part of the central axis body of the upper top, and moves downwardly when being pressed down by the top cap, thereby releasing the clipping with the central axis body of the upper top and meshing with the snap member, wherein at this moment, the top cap rotates the clutch transmission mechanism to drive the snap member to rotate, and when the downward pressing force by the top cap disappears, the clutch transmission mechanism automatically moves upwardly and is reset.

6. The combined toy top that can be freely assembled according to claim 1, characterized in that a snap protrusion locking structure is provided on the top rings for connecting with a corresponding central axis body, and the top rings are reliably connected to a corresponding central axis body through the snap protrusion locking structure; alternatively, a retaining structure is provided on each central axis body for reliable rotating connection with a corresponding one of the top rings.

7. The combined toy top that can be freely assembled according to claim 5, characterized in that a snap protrusion locking structure is provided on each of the screw rings, and the upper and bottom top rings are reliably connected to a corresponding central axis body by means of the engagement between the snap protrusion locking structure on the corresponding screw ring and a retaining structure disposed on a corresponding central axis body.

8. The combined toy top that can be freely assembled according to claim 7, characterized in that the upper cap rings and the lower cap rings have different shapes or configurations of center of gravity, the snap protrusion locking structures each comprise an upper snap protrusion and a lower snap protrusion that are provided correspondingly on the inner walls of the upper cap ring and the lower cap ring, when a corresponding central axis body is fitted into the ring hole of the corresponding upper cap ring and lower cap ring, the upper cap ring and the lower cap ring are engaged with the retaining structure provided on the corresponding central axis body, thereby achieving a reliable connection with the central axis body.

9. The combined toy top that can be freely assembled according to claim 8, characterized in that a snap edge is integrally formed on an inner wall of the through hole of each attack ring, a notch is correspondingly formed at a position of the upper cap rings and the lower cap rings that correspond to the snap edge, and the upper cap rings and the lower cap rings are reliably positioned on a corresponding attack ring by means of the engagement between the notch thereof and the snap edge.

10. The combined toy top that can be freely assembled according to claim 7, characterized in that both central axis bodies comprise axis jackets and snap rings rotatably disposed on the axis jackets, the retaining structure comprises a snap groove formed axially on an external wall of a corresponding axis jacket for the snap protrusion locking structure to slide in, and a snap pin integrally formed on the snap rings and extending out of the axis jacket, a guide groove is correspondingly formed on the external wall of each of the axis jackets for a corresponding snap pin to extend out and rotate horizontally, when the snap protrusion locking structure of one screw ring slides into a corresponding snap groove, a corresponding snap ring may be rotated such that the snap pin rotates to under or above the snap protrusion locking structure, making the snap protrusion locking structure reliably locked between the snap pin and one end edge of the snap groove so as to realize the reliable connection between a corresponding top ring and a corresponding central axis body.

11. The combined toy top that can be freely assembled according to claim 10, characterized in that the axis jacket of the upper top comprises upper and lower axis jackets in a fitting engagement, the snap member comprises a connection seat rotatably disposed on a lower part of the lower axis jacket and a fitting pole disposed below the connection seat and having snap protrusions on two external walls, the snap ring and the clutch transmission mechanism are disposed inside the upper axis jacket above the snap member, when the clutch transmission mechanism moves upwardly, it can be snapped to the upper axis jacket, and when moving downwardly to release the snap with the upper axis jacket, it can mesh with the snap member on the lower axis jacket.

12. The combined toy top that can be freely assembled according to claim 11, characterized in that the clutch transmission mechanism comprises a ring disposed above the snap member and a clutch ring disposed above the ring in a vertically movable manner, the snap ring is disposed between the upper axis jacket and the clutch ring, an upper part of the clutch ring may be snapped with the upper axis jacket, and when being pressed down to move downwardly, it can release the snap with the upper axis jacket and mesh with the snap member, when the downward pressing force disappears, the clutch ring automatically moves upwardly and is reset under the action of the ring, and moreover, a retaining structure is correspondingly provided inside the clutch ring for engagement and snap lock with protrusions formed on two sides of a lower part of the top cap, when the top cap engages with the retaining structure for locking with its bottom inserted into the clutch ring, a lower cap edge of the top cap is disposed on the upper part of the clutch ring.

13. The combined toy top that can be freely assembled according to claim 12, characterized in that a protrusion and a snap groove capable of engagement are correspondingly formed on an inner wall of the upper axis jacket and an upper external wall of the clutch ring , and meshable upper and lower raised tooth structures are provided on the bottom of the retaining structure and the upper end of the snap member, respectively.

14. The combined toy top that can be freely assembled according to claim 10, characterized in that the axis jacket of the bottom top comprises upper and lower axis jackets in a fitting engagement, wherein an upper part of the lower axis jacket is inserted into the upper axis jacket to form a cavity for engagement and fitting of the snap member of the central axis body of the upper top, the snap position is disposed on the inner wall of the cavity, and the snap pin is rotatably disposed between the upper and lower axis jackets.

15. The combined toy top that can be freely assembled according to claim 14, characterized in that the bottom of the lower axis jacket of the bottom top is connected to an elastic top tip, upper and lower limiting shoulders are correspondingly formed on the inner wall of the lower axis jacket for engagement with the elastic top tip, and alternatively, an uplift member and a lower limiting shoulder are provided inside the lower axis jacket for engagement with the elastic top tip.

16. The combined toy top that can be freely assembled according to claim 4, characterized in that the snap member of the upper top is provided with a top tip on the bottom thereof.

17. The combined toy top that can be freely assembled according to claim 4, characterized in that at least one of the top rings has different structural shapes or configurations of center of gravity for the top face and bottom face thereof.

18. The combined toy top that can be freely assembled according to claim 2, characterized in that the upper top and the bottom top are reliably connected together by means of a rotation snap structure provided on the upper and bottom top rings; alternatively, the upper top and the bottom top may be reliably connected together by means of an insertion connection structure or a rotation snap structure provided on the central axis body of the upper top and bottom top.

19. The combined toy top that can be freely assembled according to claim 2, characterized in that a snap protrusion locking structure is provided on the top rings for connecting with a corresponding central axis body, and the top rings are reliably connected to a corresponding central axis body through the snap protrusion locking structure; alternatively, a retaining structure is provided on each central axis body for reliable rotating connection with a corresponding top ring.

20. A combined toy top that can be freely assembled, comprising an upper top and a bottom top that are assembled together, characterized in that the upper top and the bottom top each comprise a central axis body and a top ring fitting over the central axis body, the direction in which the top ring of at least one top of the upper top and the bottom top is installed on the central axis body can be turned over between a top face and a bottom face, and therefore, a combined toy top with a variety of assembly structures may be achieved by turning the direction of the top rings on the central axis body;

wherein the upper top and the bottom top are reliably connected together by means of a rotation snap structure provided on the central axis bodies of the upper top and bottom top; and wherein the rotation snap structure on the central axis bodies comprises a snap member that is rotatably disposed at the bottom of the central axis body of the upper top, and a cavity is correspondingly formed on the upper part of the central axis body of the bottom top for the snap member to be inserted in, and a snap position is provided within the cavity for rotation engagement with the snap member, and the reliable snap connection of the two central axis bodies can be realized by inserting the snap member at the bottom of the central axis body of the upper top into the cavity of the bottom top and then rotating the snap member, and the cavity of the bottom top may also engage with a bottom of a top cap removably installed thereon.

* * * * *